United States Patent [19]

Lin

[11] Patent Number: 4,903,853

[45] Date of Patent: Feb. 27, 1990

[54] FOLDING BASKET WITH NOVEL JOINT STRUCTURE

[76] Inventor: Chin C. Lin, P.O. Box 1-79, Taipei, Taiwan

[21] Appl. No.: 363,851

[22] Filed: Jun. 9, 1989

[51] Int. Cl.[4] ..... B65D 6/12

[52] U.S. Cl. ..... 220/6; 220/9.2; 220/19

[58] Field of Search ..... 220/9.2, 9.3, 6, 19

[56] References Cited

U.S. PATENT DOCUMENTS

| | | | |
|---|---|---|---|
| 1,076,623 | 10/1913 | Bond | 220/6 |
| 1,443,901 | 1/1923 | Murray | 220/6 |
| 1,521,936 | 1/1925 | Fadden et al. | 220/6 |
| 1,833,857 | 11/1931 | Reese | 220/19 |
| 1,848,929 | 3/1932 | Berg | 220/9.2 |
| 1,905,137 | 4/1933 | Blomberg | 220/6 |
| 2,489,188 | 11/1949 | Landry | 220/6 |

*Primary Examiner*—Joseph Man-Fu Moy
*Attorney, Agent, or Firm*—Lalos & Keegan

[57] ABSTRACT

A folding basket having an upper frame and a lower frame and first and a second fences rotarily connected to the upper and lower frames, wherein the second fences are provided with hinge-like joint structure in their middle portions, permitting the basket to be easily folded up and assembled, and, furthermore, the bottom fence of the basket can be easily replaced with a new one when damaged.

3 Claims, 7 Drawing Sheets

FOLDING BASKET WITH NOVEL JOINT STRUCTURE

BACKGROUND OF THE INVENTION

Most conventional hand-carried baskets can not be folded up when not used, and thus cause much inconvenience to storage and carrying.

While a folding basket is often complicatedly constructed, and, moreover, a damaged component thereof is often unchangeable, and the whole basket must be replaced with a new one to cause waste.

It is therefore tried by the inventor to deal with the above problems, attempting to develop a new folding basket without aforesaid shortcomings.

SUMMARY OF THE INVENTION

It is a primary object of the present invention to provide a folding basket with novel joint structure, which can be assembled manually and the components of which are changeable when damaged to elongate the using life of the basket.

It is a further object of the present invention to pvovide the above folding basket wherein the components thereof can be massively manufactured in advance, and then sold by package whereby the user himself can assemble those components into the basket manually without any tools.

It is still a further object of the present invention to provide the above folding basket wherein the components thereof can be assembled quickly and manufactured at greatly lowered cost.

It is still a further object of the present invention to provide the above folding basket, which can be folded up into a flat form with minimum volume.

The present invention can be best understood through the following description and accompanying drawings wherein:

DETAILED DESCRIPTION OF THE PREFERRED EMBODIMENT

Figure 1:
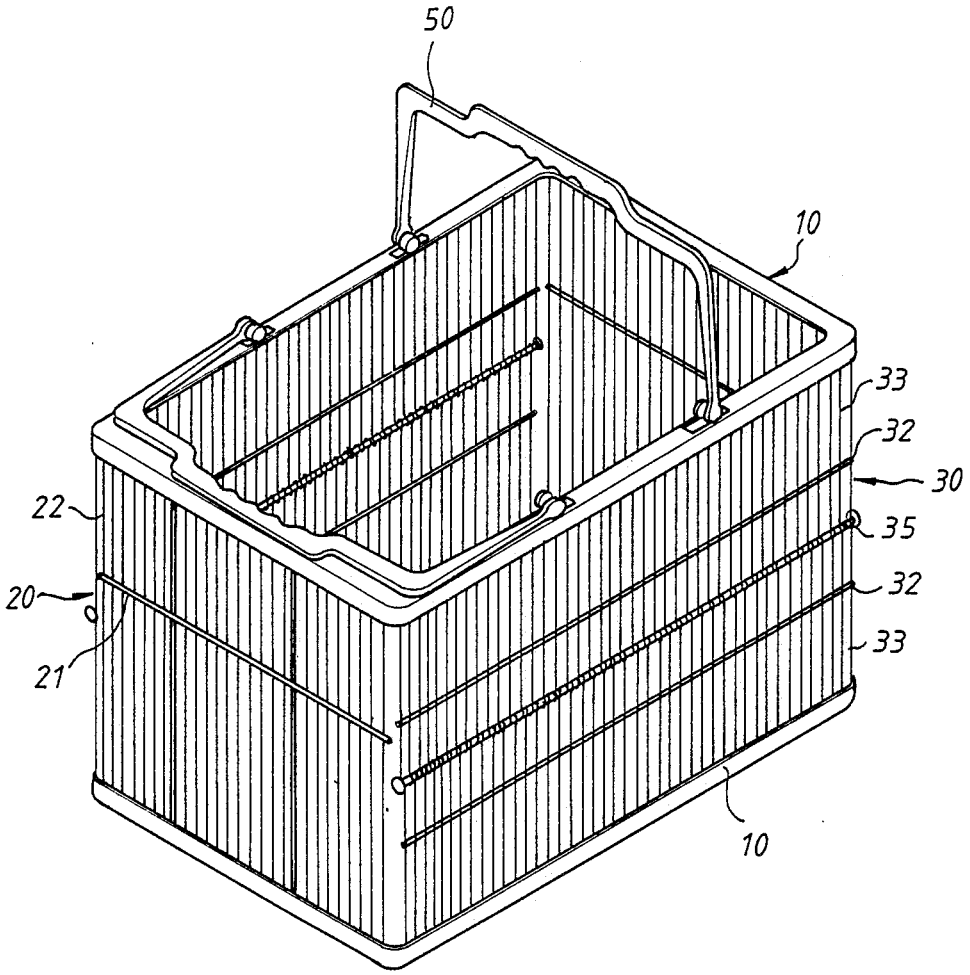
FIG. 1 is a perspective view of the present invention.
Figure 2:
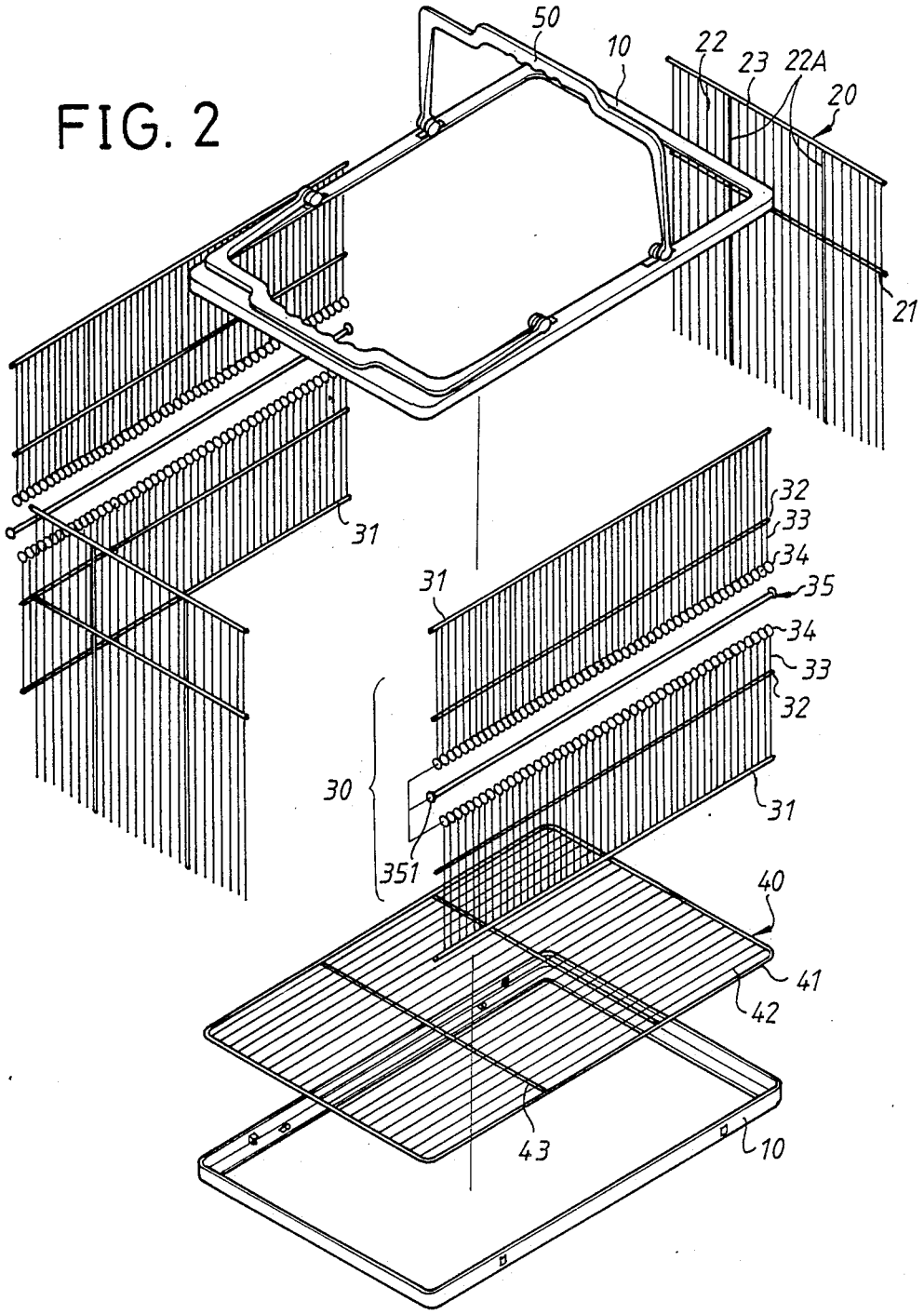
FIG. 2 is an exploded view of the present invention.

Please first refer to FIGS. 1 and 2. The folding basket of the present invention includes an upper frame and a lower frame 10—10, a pair of transverse fences 20—20, a pair of longitudinal fence 30—30, a bottom fence 40, and a handle 50.

The upper and lower frames 10 are made from L-shaped beams and formed in a rectangular shape. The transverse fence 20 includes a top horizontal large diameter main rod 23, a horizontal support rod 21 disposed under the main rod 23, and plural vertical slender rods 22 welded to the main rod 23 and support rod 21 to form the transverse fence body 20. The support rod 21 is located on a level higher than the middle portion of the slender rod 22 for the convenience of folding of the basket. Furthermore, two relative large diameter enhancing rod 22A are provided among the slender rods 22 to increase supporting strength thereof.

While the bottom fence 40 includes large diameter peripheral frame 41, plural longitudinal slender rods 42 and transverse slender rods 43 welded to the longitudinal slender rods 42 and the peripheral frame 41 to form the bottom fence 40.

The longitudinal fence 30 includes upper and lower two symmetrical portions 31, each of the symmetrical portions 31 having a horizontal longitudinal large diameter rod 31, a horizontal longitudinal slender rod 32 and plural vertical slender rods 33, which are welded to the large diameter rod 31 and horizontal slender rod 32, wherein each free end of the vertical slender rods 33 is formed into a circular portion 34 whereby a shaft rod 35 can go therethrough to form a hinge-like joint structure, and, by means of two enlarged ends 351 of the shaft rod 35, the circular portions 34 are rotarily confined between the two enlarged ends 351.

The main rod 23 of the transverse fence 20 is rotarily mounted on the corner portion of the L-shaped upper frame 10. Similarly, two horizontal longitudinal large diameter rods of the longitudinal fence 20 are also rotarily mounted on the corners of the L-shaped upper and lower frames 10 respectively, as shown in FIG. 4 to FIG. 7.

Figure 3:
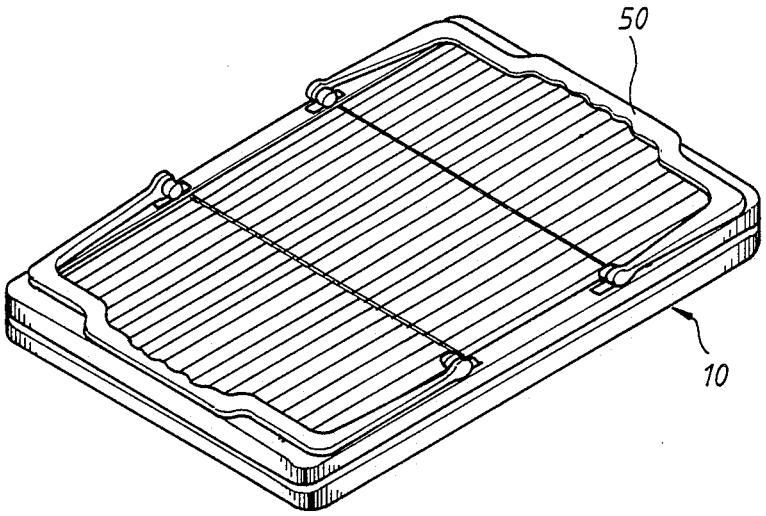
FIG. 3 is a perspective view of the folded up basket of the present invention.
Figure 4:
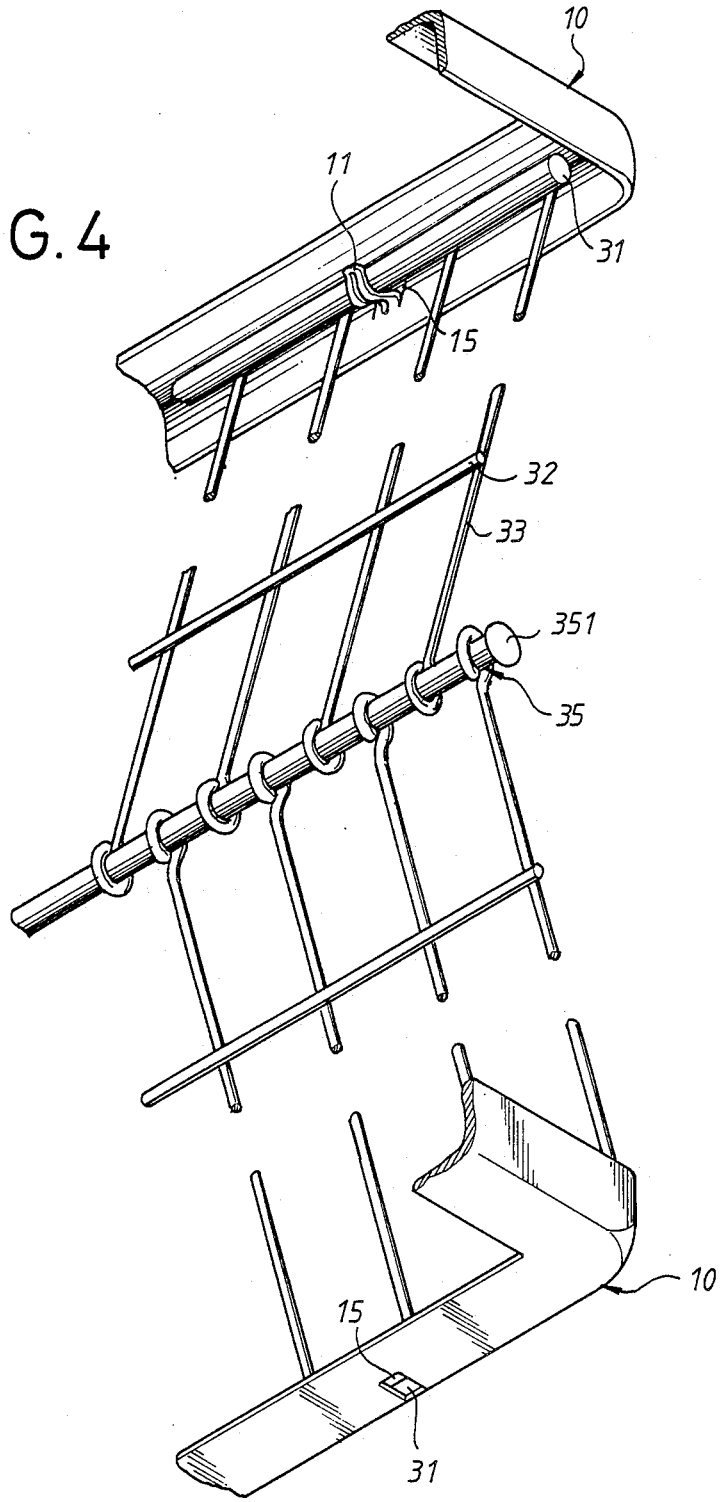
FIG. 4 shows the joint portion of the present invention.
Figure 8A:
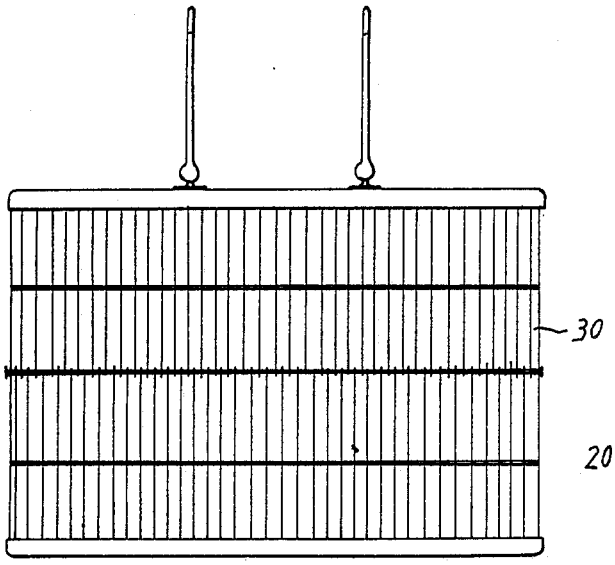
FIG. 8A is a front view of the present invention before it is being folded up.
Figure 9A:
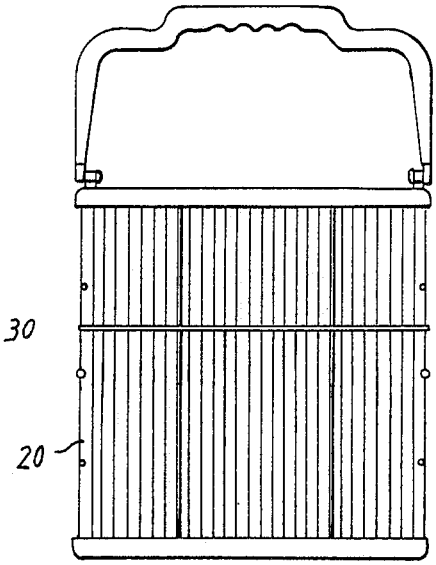
FIG. 9A is a side view of the present invention before it is being folded up.
Figure 8B:
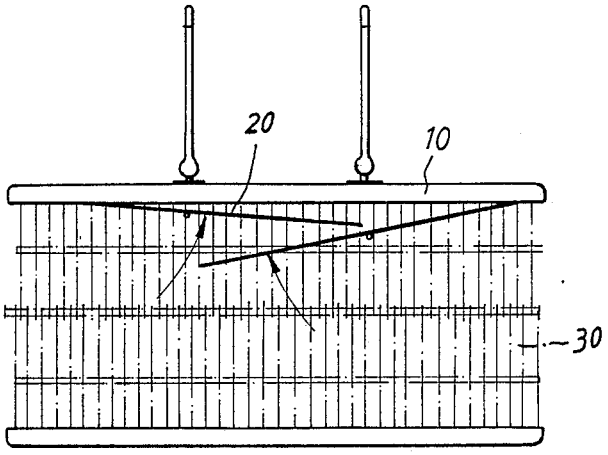
FIG. 8B is a front view of the present invention when it is in the manner of being folded up.
Figure 9B:
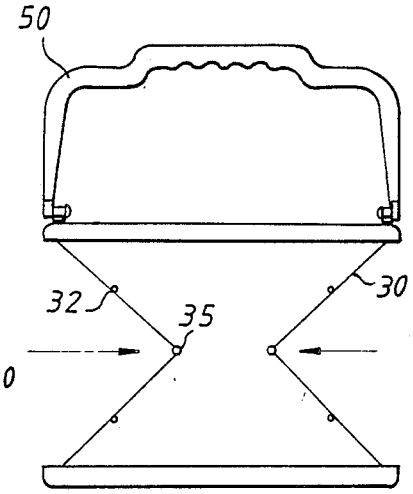
FIG. 9B is a side view of the present invention when it is in the manner of being folded up.

When it is to be folded up, as the bottom portion of the transverse fences 20 is free, the transverse fences 20 can be readily pushed inward manually, as shown in FIG. 8B, and the longitudinal fences 30 will consequently fold inward in the manner as shown in arrow of FIG. 9B. In this manner the upper frame 10 can be pressed down to convert the basket into a flat body as shown in FIG. 3.

Reversely, the upper frame 10 can be lifted upward to make the longitudinal fences 30 stand up, and then the transverse fences 20 can be pushed outward manually to form an extended basket as shown in FIGS. 1, 8A and 9A.

The main rod 23 of the transverse fence 20 and the large diameter rods 31 of the longitudinal fence 30 can be rotarily connected to the upper and lower frames 10 in many alternative manners.

Figure 5:
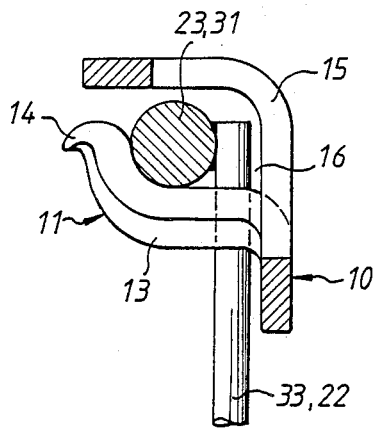
FIG. 5 is a cross-sectional view of the joint portion according to FIG. 4.
Figure 6:
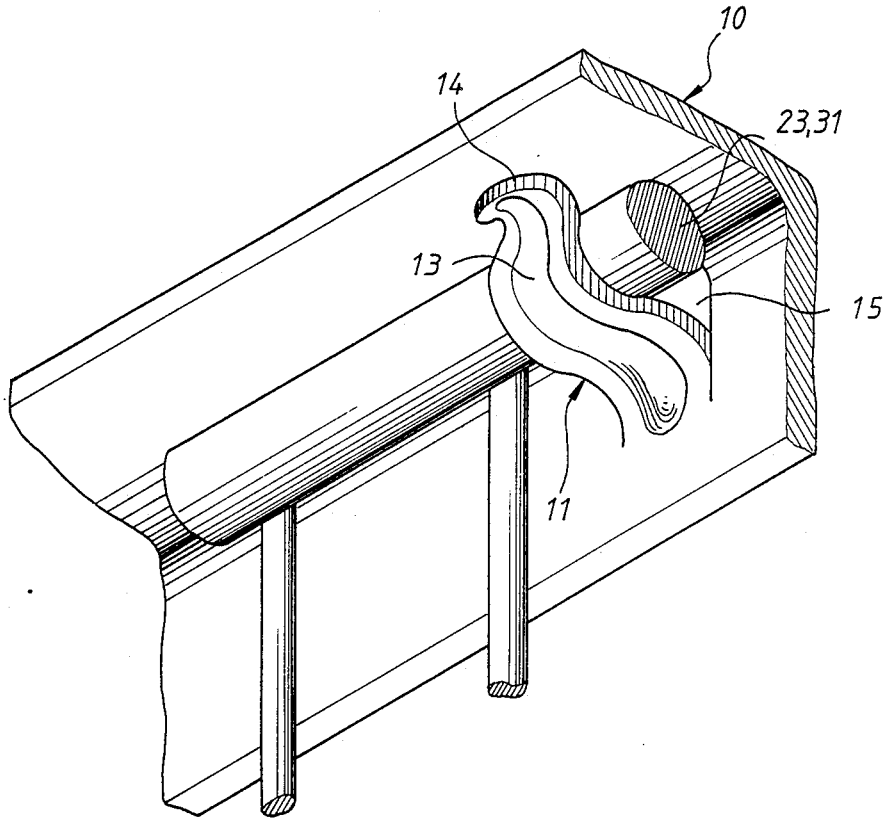
FIG. 6 is an enlarged view according to FIG. 5.
Figure 7:
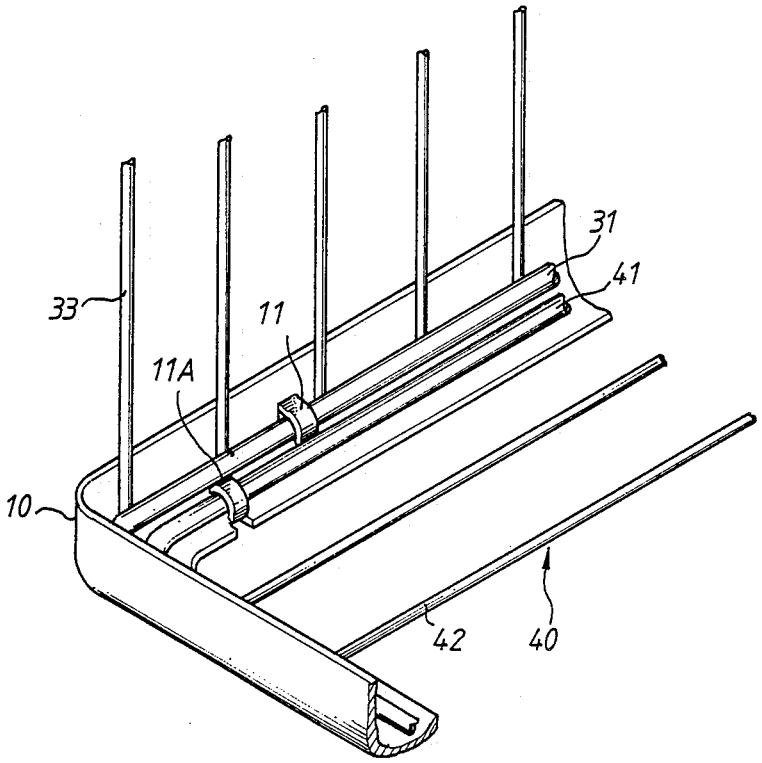
FIG. 7 shows the joint portions on the lower frame, respectively joining the bottom fence and longitudinal fence with the lower frame.

The preferred embodiment thereof is as shown in FIG. 4 to FIG. 7, wherein a window 15 is punched on the corner portion of the upper frame 10 as shown in FIGS. 5 and 6 to form a clamping hood 11. The main rod 23 and large diameter rods 31 are rotarily clamped and received in the clamping hooks 11 so as to rotarily engage with the upper and lower frames 10.

As shown in FIGS. 5 and 6, the clamping hook 11 is upward open with a clamping lip 14 provided at its front end, whereby the main rod 23 and large diameter rods 31 can be easily pushed into the clamping hook 11. As shown in FIG. 5, after the main rod 23 or large diameter rods 31 together with the vertical slender rods 22, 33 are pushed into and clamped in the clamping hook 11, a gap 16 is still left therebetween, permitting the folding of the basket. Moreover, a reinforcing rib 13 can be punched on the clamping hook 11 to increase its mechanical strength.

Additionally, the bottom fence 40 is fixedly mounted on the lower frame 10 with its peripheral frame 41 clamped in the inward open clamping hood 11A of the lower frame 10. The clamping hooks 11 and 11A are located in different positions so as not to affect the mechanical strength of the lower frame 10.

The bottom fence 40 appears to be most easy to rust and damage amount the components of the basket. However, the bottom fence 40 of the present invention can be easily replaced with a new one without wasting the whole basket when rusted.

I claim:

1. A folding basket with novel joint structure comprising:

an upper frame;

a lower frame;

a first pair of opposite fences each having a horizontal large diameter main rod, a horizontal support rod, and plural vertical slender rods connected to said main rod and support rod;

a second pair of opposite fences, disposed perpendicularly to said first fences, each having symmetrical upper portion and lower portion, each of said symmetrical portions having a horizontal large diameter rod, a horizontal slender rod, and plural vertical slender rods connected to said horizontal large diameter rod and horizontal slender rod, each of said vertical slender rods having a circular free end located in middle portion of said second fence whereby a shaft rod can go through said circular free ends a hinge-like joint structure rotarily connect said symmetircal portions, permitting them to be inward folded up; and a bottom fence disposed on said lower frame, said main rods of said first fences being rotarily mounted on said upper frame whereby said first fences can be pushed inward manually to permit said second fences to be folded up inward and convert said folding basket into a floded up flat form.

2. A folding basket as claimed in claim 1, wherein said horizontal large diameter rods of said second fences are rotarily mounted on said upper and lower frames.

3. A folding basket as claimed in claim 1, wherein said upper and lower frames are punched with clamping hooks to rotarily clamp and receive said main rods and horizontal large diameter rods of said first and second fences, permitting said first and second fences to rotarily engage with said upper and lower frames.

* * * * *